US007293318B1

(12) United States Patent
Kuo

(10) Patent No.: US 7,293,318 B1
(45) Date of Patent: Nov. 13, 2007

(54) HOLLOW TOOTHBRUSH ADAPTED FOR FLUID DRAINING

(76) Inventor: Tai-Jun Kuo, 5th Floor, No. 29, Lane 137, Sec. 3, Chungching North Road, Taipei (TW)

( * ) Notice: Subject to any disclaimer, the term of this patent is extended or adjusted under 35 U.S.C. 154(b) by 0 days.

(21) Appl. No.: 11/503,190

(22) Filed: Aug. 14, 2006

(51) Int. Cl.
*A46B 9/04* (2006.01)

(52) U.S. Cl. ..... 15/167.1; 15/248.1

(58) Field of Classification Search ..... 15/167.1, 15/205.2, 248.1
See application file for complete search history.

(56) References Cited

U.S. PATENT DOCUMENTS 851,550 A * 4/1907 Nevius ..... 15/248.1
1,501,020 A * 7/1924 Small ..... 15/248.1
1,899,242 A * 2/1933 McNab ..... 248/110
2,394,640 A * 2/1946 Singer ..... 15/248.1
3,968,950 A * 7/1976 Gallo ..... 248/688
5,842,248 A * 12/1998 Van Grol et al. ..... 15/167.1
5,875,516 A * 3/1999 Blue ..... 15/248.1
5,970,562 A * 10/1999 Lalevee, Sr. ..... 15/167.1

* cited by examiner

*Primary Examiner*—Randall Chin
(74) *Attorney, Agent, or Firm*—Volentine & Whitt, PLLC

(57) ABSTRACT

This invention relates to a hollow toothbrush adapted for fluid draining comprising a brush head having a neck portion and a bristle portion disposed on the neck portion, and a hollow brush stem form a drain passage with a first opening and a second opening respectively formed at two opposite ends thereof. The neck portion is partially inserted into the drain passage through the first opening and is formed with a plurality of ribs radially extending from the neck portion to the brush stem, so as to securely fix the brush head to the brush stem by the ribs. During teeth brushing, the mixed liquid of dentifrice and saliva flows along the neck portion through the first opening into the brush stem and then flows out the brush stem through the second opening, and thereby the mixed liquid is prevented from contaminating the user's hand gripping the toothbrush.

7 Claims, 2 Drawing Sheets

HOLLOW TOOTHBRUSH ADAPTED FOR FLUID DRAINING

BACKGROUND OF THE INVENTION

1. Field of the Invention

This invention relates to a toothbrush, especially to a hollow toothbrush adapted for fluid draining, which is adapted to drain fluid from the user's mouth and prevent liquid from contaminating the user's hand gripping the toothbrush during teeth brushing.

2. Description of the Related Art

The toothbrush as a tool for cleaning teeth has been known as an indispensable daily article in modern families.

Generally, the way to use a toothbrush is to apply dentifrice to the bristles, grip the stem of the toothbrush, and then brush the teeth to and fro.

However, during teeth brushing, the saliva secreted by the user mixes with the dentifrice on the bristles to form a sticky and very unpleasant liquid. Then, the user's hand gripping the toothbrush is contaminated by the mixed liquid flowing along the toothbrush.

In view of the above, it is necessary to provide a toothbrush for the public that prevents the mixed liquid of dentifrice and saliva from contaminating a user's hand during teeth brushing.

SUMMARY OF THE INVENTION

It is an object of the present invention to provide a hollow toothbrush adapted for fluid draining, so that the mixed liquid of dentifrice and saliva is prevented from contaminating the user's hand during teeth brushing.

In order to achieve the above object, the hollow toothbrush adapted for fluid draining of the present invention comprises a brush head having a neck portion and a bristle portion disposed on the neck portion, and a hollow brush stem to forming a drain passage along the length of the stem from a first opening to a second opening respectively formed at two opposite ends of the stem. The neck portion of the brush head is partially inserted into the drain passage through the first opening and is formed with a plurality of ribs radially extending from the neck portion to connect to the brush stem, so as to securely fix the brush head to the brush stem by the ribs. A plurality of flow channels is defined between ribs and axially communicate with the drain passage.

When using the toothbrush of the present invention, the user grips the brush stem and cleans teeth using the bristle portion of the brush head. During teeth brushing, the mixed liquid of dentifrice and saliva flows downwardly along the neck portion of the brush head. A sump flange provided around the first end of the brush stem gathers liquid to prevent spilling. Then, the mixed liquid flows through the first opening into the flow channels defined between the ribs in the stem. Fluid then flows to the drain passage, which is in fluid communication with the flow channels. At last, fluid flows out of the stem through the second opening. Therefore, the undesired circumstance of mixed liquid contaminating the user's hand is avoided. This and other objects and advantages of the present invention will become apparent to those skilled in the art from the following detailed description of the invention and the accompanying drawings. However, the description is only to describe the preferred embodiments of the invention, not to limit the invention in any form. Any modification or changes in the same spirit of the invention should be within the scope of protection for this invention.

DESCRIPTIONS OF THE DRAWINGS

DETAILED DESCRIPTION OF THE INVENTION

Figure 1:
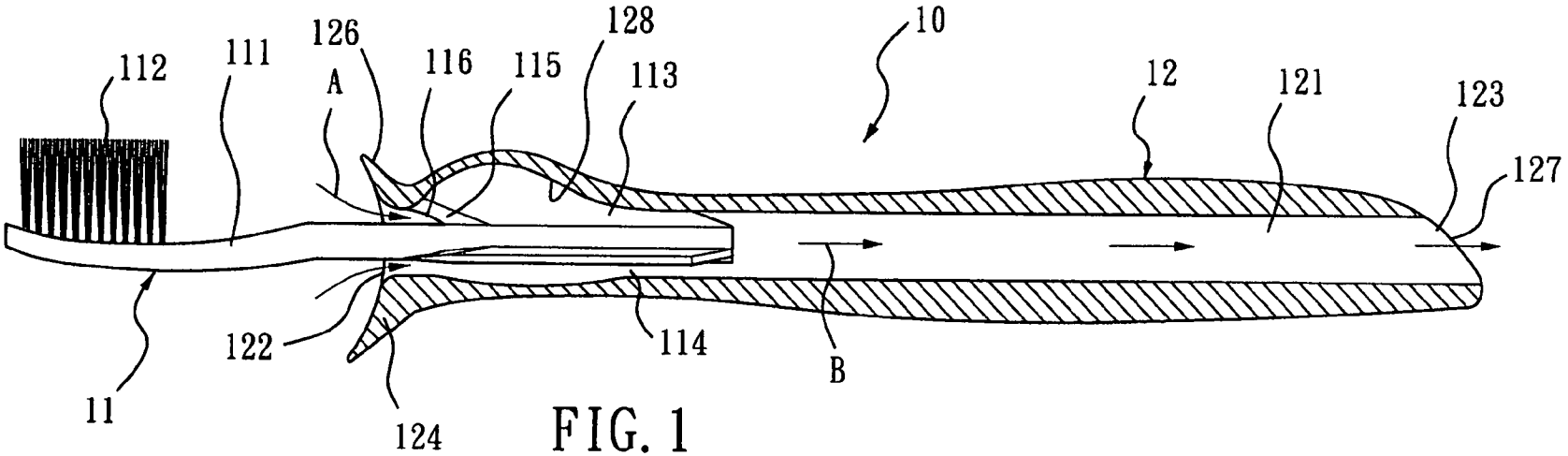
FIG. 1 is a longitudinal cross-sectional view of a hollow toothbrush adapted for fluid draining according to an embodiment of the present invention.
Figure 2:
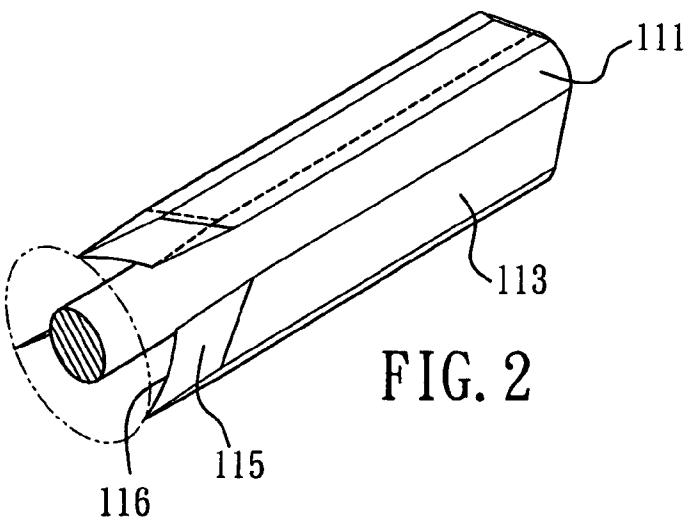
FIG. 2 is a partial schematic view of a neck portion of a brush head of a hollow toothbrush adapted for fluid draining according to an embodiment of the present invention.

As shown in FIG. 1, the hollow toothbrush 10 of the present invention is adapted to drain the mixed liquid of dentifrice and saliva during teeth brushing through an appropriate way (as shown by the arrows A and B in FIG. 1), so as not to contaminate the user's hand gripping the toothbrush 10.

The hollow toothbrush 10 adapted for fluid draining comprises a brush head 11 having a neck portion 111 and a bristle portion 112 disposed on the neck portion 111, and a hollow brush stem 12 forming a drain passage 121 extending longitudinally from a first end 126 to a second end 127 with a first opening 122 and a second opening 123 respectively formed at the two opposite ends 126 and 127. The neck portion 111 of the brush head 11 is partially inserted into the drain passage 121 of the brush stem 12 through the first opening 122. A plurality of ribs 113 is integrally formed on the neck portion 111 of the brush head 11 and radially extend from the neck portion 111 to the internal wall 128 of the stem 12, so as to securely engage the neck portion 111 of the brush head 11 with the stem 12, and thereby the brush head 11 is fixed on the brush stem 12. In this preferred embodiment, the ribs 113 integrally formed on the neck portion 111 of the brush head 11 engage the internal wall 128 of the brush stem 12 by interference fit or by any suitable adhesive bonding. However, the ribs 113 can be integrally formed with the neck portion 111 of the brush head 11 and the internal wall 128 of the brush stem 12.

When the neck portion 111 of the brush head 11 is inserted within the drain passage 121, a plurality of flow channels 114 is defined between each rib 113 and between the internal wall 128 of the stem 12 and the neck portion 111 of the brush head 11. The flow channels 114 are in fluid communication with the drain passage 121 along the axial direction of the brush stem 12. A sump flange 124 is formed around the first opening 122 and radially extends from the brush stem 12, so as to form a collecting region at the first opening 122 for improving the efficiency of gathering fluid.

Figure 3:
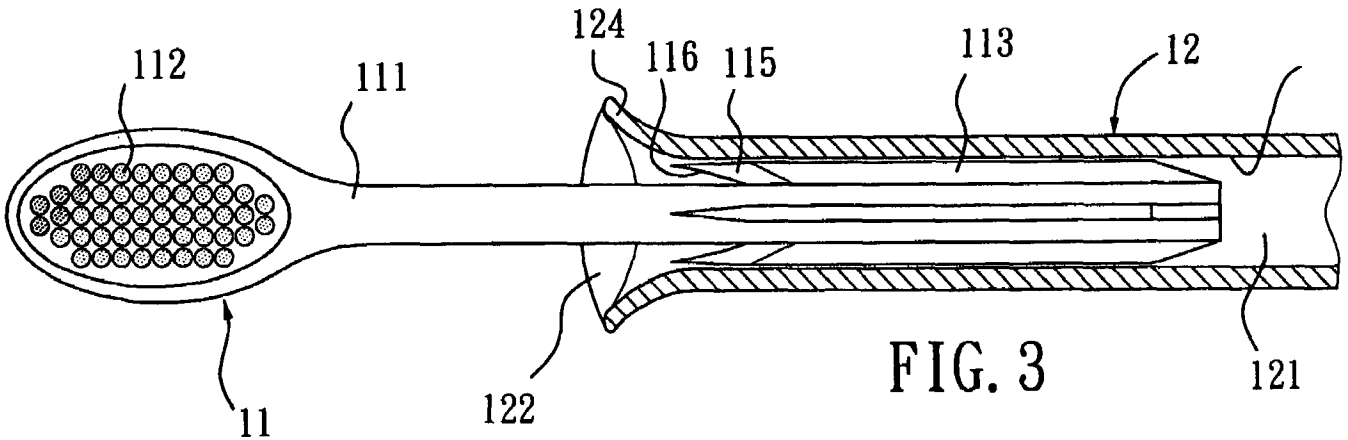
FIG. 3 is a partial cross-sectional view of a hollow toothbrush adapted for fluid draining according to an embodiment of the present invention.

The internal wall 128 of the brush stem 12 can be arched outwardly (as shown in FIG. 1), so as to increase the size of the cross-section of the flow channel 114, or it can be a flat wall (as shown in FIG. 3).

When the toothbrush 10 is in use, the user grips the brush stem 12 and cleans teeth using the bristle portion 112 of the brush head 11. During brushing, if the stem 12 is below the brush head 11, the mixed liquid of dentifrice and saliva flows downwardly along the neck portion 111 of the brush head 11, and the sump flange 124 gathers liquid to prevent spilling. Then, the mixed liquid flows through the first opening 122 into the flow channels 114 defined by the ribs 113 in the stem 12. Then, fluid flows to the drain passage 121 longitudinally communicating with the flow channels 114. Lastly, fluid flows out the stem 12 through the second opening 123. Therefore, the circumstance of mixed liquid contaminating the user's hand is avoided.

In order to keep fluid flowing smoothly into the flow channels 114, each rib 113 is respectively formed with a sharp slant 115 in the proximity of the first opening.

Further, in order to prevent bubbles in the mixed liquid from blocking the entrance of the flow channels 114, each rib 113 is respectively formed with an edge 116 on the free end of the slant 115, so as to cut the bubbles.

Figure 4C:
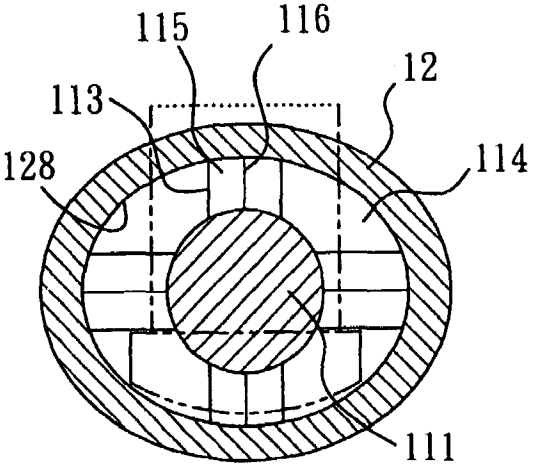
FIG. 4C is a transverse cross-sectional view of a hollow toothbrush adapted for fluid draining according to a third embodiment of the present invention.
Figure 4B:
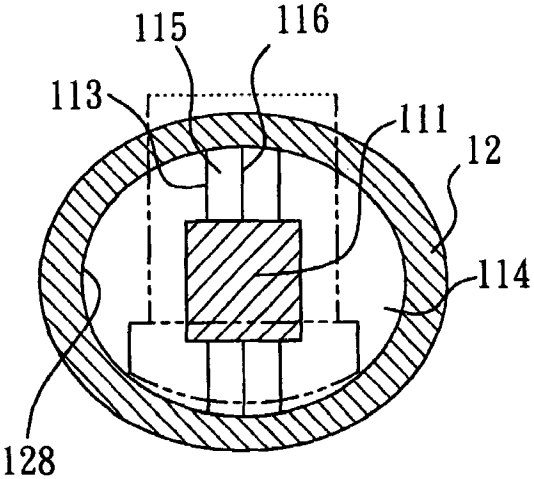
FIG. 4B is a transverse cross-sectional view of a hollow toothbrush adapted for fluid draining according to a second embodiment of the present invention.
Figure 4A:
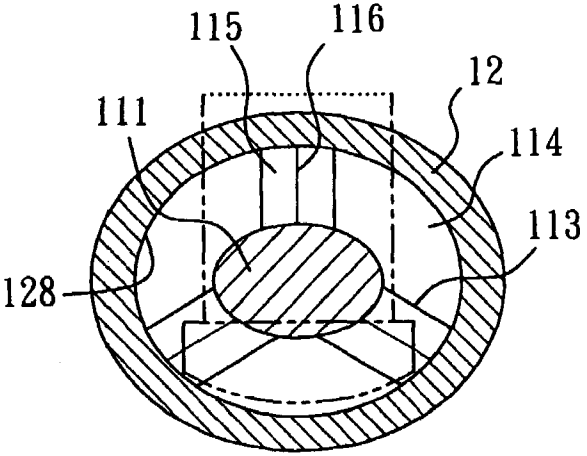
FIG. 4A is a transverse cross-sectional view of a hollow toothbrush adapted for fluid draining according to a first embodiment of the present invention.

FIG. 4A illustrates a transverse cross-section of a hollow toothbrush adapted for fluid draining according to a first embodiment of the present invention. FIG. 4B illustrates a transverse cross-section of a hollow toothbrush adapted for fluid draining according to a second embodiment of the present invention. FIG. 4C illustrates a transverse cross-section of a hollow toothbrush adapted for fluid draining according to a third embodiment of the present invention. As shown in the above figures, the cross-section of the neck portion 111 can be any shape, such as an oval (as shown in FIG. 4A), a rectangle (as shown in FIG. 4B) or a circle (as shown in FIG. 4C). Moreover, the number of ribs 113 which connect the brush head 11 with the brush stem 12 is not restricted. For example, three ribs 113 (see FIG. 4A) are angularly, equidistantly arranged on the neck portion 111, and thereby three flow channels 114 are formed between the internal wall 128 of the brush stem 12 and the neck portion 111 of the brush head 11, or two ribs 113 (see FIG. 4B) are angularly, equidistantly arranged on the neck portion 111, and thereby two flow channels 114 are formed, or four ribs 113 (see FIG. 4C) are angularly equidistantly arranged on the neck portion 111, and thereby four flow channels 114 are formed.

Although the present invention has been described in relation to particular embodiments thereof, many other variations and modifications and other uses may become apparent to those skilled in the art. It is preferred, therefore, that the present invention be limited not by this specific disclosure herein, but only by the appended claims.

What is claimed is:

1. A hollow toothbrush adapted for fluid draining, comprising:

a brush head having a neck portion and a bristle portion disposed on the neck portion; and a hollow brush stem forming a draining passage longitudinally extending from a first end to a second end with a first opening and a second opening respectively formed at two opposite ends;

wherein the neck portion is partially inserted into the drain passage through the first opening, a plurality of ribs radially extending from the neck portion to connect to the brush stem, so as to connect the brush head to the brush stem by the ribs, and a plurality of flow channels defined between the ribs and axially communicating with the drain passage.

2. The hollow toothbrush according to claim 1, wherein the brush stem is formed with a sump flange at the first opening.

3. The hollow toothbrush according to claim 1, wherein each of the ribs is respectively formed with a slant in the proximity of the first opening.

4. The hollow toothbrush according to claim 3, wherein each of the ribs is formed with an edge on the free end of the slant.

5. The hollow toothbrush according to claim 1, wherein the ribs are two ribs angularly, equidistantly arranged on the neck portion.

6. The hollow toothbrush according to claim 1, wherein the ribs are three ribs angularly, equidistantly arranged on the neck portion.

7. The hollow toothbrush according to claim 1, wherein the ribs are four ribs angularly, equidistantly arranged on the neck portion.

* * * * *